US006152160A

United States Patent [19]

Bowden Wilcox et al.

[11] Patent Number: 6,152,160

[45] Date of Patent: Nov. 28, 2000

[54] MODULAR VACUUM DRAINAGE SYSTEM

[75] Inventors: Ruth J. Bowden Wilcox, New Milford; Bjorn von Palffy, South Beloit; Tom Beatty, Roscoe; Doug Wallace, Roscoe; Mark Pondelick, Roscoe; Ian Tinkler, Rockford, all of Ill.

[73] Assignee: Evac International OY, Helsinki, Finland

[21] Appl. No.: 09/385,210

[22] Filed: Aug. 30, 1999

[51] Int. Cl.[7] ..... F04F 3/00

[52] U.S. Cl. ..... 137/15.01; 137/205; 137/357

[58] Field of Search ..... 137/15.01, 205, 137/357

[56] References Cited

U.S. PATENT DOCUMENTS

| | | | |
|---|---|---|---|
| 3,239,849 | 3/1966 | Liljendahl | 4/77 |
| 4,120,312 | 10/1978 | Michael | 137/236 R |
| 4,171,853 | 10/1979 | Cleaver et al. | 406/48 |
| 4,179,371 | 12/1979 | Foreman et al. | 210/63 R |
| 4,209,034 | 6/1980 | Michael | 137/236 R |
| 4,373,838 | 2/1983 | Foreman et al. | 406/14 |
| 4,865,631 | 9/1989 | Stroby et al. | 55/163 |
| 5,002,592 | 3/1991 | Stroby et al. | 55/169 |

*Primary Examiner*—Gerald A. Michalsky
*Attorney, Agent, or Firm*—Marshall, O'Toole, Gerstein, Murray & Borun

[57] ABSTRACT

A modular vacuum drainage system is provided which facilitates quick and easy installation in a building. The system includes a vacuum central housed in an enclosure and having interface connections located adjacent to a periphery of the enclosure to allow immediate access thereto. The vacuum central is sized to fit through standard doorway sizes, and is preferably housed in a soundproof enclosure so that the vacuum central may be installed in a room without requiring a separate mechanical room. The enclosure may be decorated to match the decor of the office, thereby providing an aesthetically pleasing appearance. A modular plumbing fixture is also provided which may be pre-fabricated off-site. The modular plumbing fixture is provided in a housing and has water and vacuum pipe inlets accessible from outside of the housing to facilitate connection to the vacuum central. The modular plumbing fixture may be attached to the vacuum central using vacuum piping disposed in a piping enclosure having an attractive exterior. The vacuum piping and piping enclosure are pre-fabricated to further minimize installation time. The modular vacuum drainage system allows a facility to be renovated with additional waste fluid sources while minimizing installation costs and production disruptions.

21 Claims, 4 Drawing Sheets

66
8
32
24
60
18
70
20
22
10
16
12
30
50
51
14
48
26

MODULAR VACUUM DRAINAGE SYSTEM

FIELD OF THE INVENTION

The present invention generally relates to drains for fluids, and more particularly to vacuum drainage systems.

BACKGROUND OF THE INVENTION

Various types of drainage systems are used to transport waste fluid from a source to a desired collection point. Gravity drainage systems, for example, use the pull of gravity to transport waste fluid. Such systems have many drawbacks. For example, options for the layout of gravity drainage piping are limited since the piping must be located below the waste fluid source and must continuously slope toward the collection point. The waste fluid source is often located on a concrete pad, so piping must be laid out before the concrete is poured. In addition, it is overly difficult to renovate or add plumbing fixtures to a gravity drainage system due to the piping location requirements. For example, handicapped-accessible toilets must be added to the washrooms in many buildings to meet the requirements of the Americans with Disabilities Act (ADA). Such renovation is performed on site, and may interrupt plumbing service for extended periods of time. In addition, personnel are often displaced during renovation, resulting in loss of production time. Furthermore, tenants of a building may be reluctant to carry out renovations to gravity drainage piping since any such improvement becomes an integral fixture of the building, and therefore must remain upon termination of the lease.

Vacuum drainage systems provide an alternative to conventional gravity drainage piping. Vacuum systems typically comprise a fixture, such as a toilet or a sink, connected to an existing fluid supply. The fixture has a drain for discharging waste fluid. The drain is connected by vacuum piping to a vacuum source which creates a negative pressure in the vacuum piping. A valve is disposed in the vacuum piping and is selectively operated to transport waste fluid from the drain to the vacuum piping and ultimately to a collection tank. As a result, the vacuum piping may be located above the waste fluid sources and may even run vertically upward, since vacuum, rather than gravity, is used to transport the waste fluid. This flexibility in locating the vacuum piping, therefore, simplifies and shortens the time needed to install and renovate plumbing fixtures. When installing or renovating a conventional vacuum drainage system, however, most of the plumbing fixtures and piping are assembled on site, and therefore many of the problems associated with gravity drainage systems are also present in vacuum drainage systems. For example, installation and renovation of conventional vacuum drainage systems still interrupts plumbing service and displaces personnel for overly lengthy periods of time.

In addition, such conventional vacuum drainage systems have typically been used in large-scale applications, such as in hotels, prisons, and shopping centers. Such systems typically comprise multiple large storage tanks and vacuum pumps, and extensive piping networks, with the major components of the system being housed in a mechanical room. In addition to housing components of the vacuum source, the mechanical room also serves to contain noise generated during operation of the vacuum drainage system. It is not feasible, however, to use such a vacuum drainage system to collect waste fluid from a few additional plumbing fixtures, as may be added in a typical office or other small-scale renovation. Furthermore, in certain spaces, such as an office building, a separate mechanical room is not typically available to house the components of the vacuum drainage system.

Conventional vacuum centrals have further been constructed on an open frame or in a free-standing arrangement in which the components are provided separately, without a frame. While an open frame facilitates access to interior components, the noise level generated by the system is undiminished and the system in general has an appearance which is unsuitable for certain applications, such as in an office.

SUMMARY OF THE INVENTION

In accordance with certain aspects of the present invention, a modular vacuum central is provided for use with vacuum drainage piping. The vacuum central comprises a frame and a tank mounted on the frame, the tank having a fluid intake connection adapted for fluid communication with the vacuum drainage piping, a vacuum inlet, a vent inlet, and a drain outlet. A vacuum generator is mounted on the frame and has an inlet in fluid communication with the vacuum inlet to create a vacuum in the tank, and an exhaust outlet. A control panel is attached to the frame and is operatively connected to the vacuum generator, the control panel having a power connection. An enclosure is attached to the frame and surrounds the tank and vacuum generator. The fluid intake connection, vent inlet, drain outlet, exhaust outlet, and power connection are located adjacent to a periphery of the enclosure.

In accordance with additional aspects of the present invention, a method of installing a vacuum central in an office of a building having a sewer line is provided. The office has vacuum drainage piping connected to a waste fluid source and a power source. The vacuum central has a frame, a tank mounted on the frame and having a fluid intake connection, a vacuum inlet, a vent inlet, and a drain outlet, a vacuum generator mounted on the frame and having an inlet in fluid communication with the vacuum inlet to create a vacuum in the tank, and an exhaust outlet. A control panel is mounted on the frame and is operatively connected to the vacuum generator, the control panel having a power connection. The method comprises the steps of transporting the vacuum central as a unit into the office, positioning the vacuum central in the office, connecting the drain outlet of the vacuum central to the sewer line, connecting the fluid intake connection to the vacuum drainage piping, and connecting the power connection to the power source.

In accordance with still other aspects of the present invention, a modular vacuum drainage system is provided for use with existing water supply piping. The modular vacuum drainage system comprises a vacuum central including a frame, a tank mounted on the frame, the tank having a fluid intake connection, a vacuum inlet, a vent inlet, and a drain outlet, a vacuum generator mounted on the frame, the vacuum generator having an inlet in fluid communication with the vacuum inlet of the tank to create a vacuum in the tank, and an exhaust outlet, a control panel attached to the frame and operatively connected to the vacuum generator, the control panel having a power connection, and a plurality of panels attached to the frame to form an enclosure surrounding the vacuum generator and tank. The fluid intake connection, vent inlet, drain outlet, exhaust outlet, and power connection are located adjacent to a periphery of the enclosure. A modular plumbing fixture assembly is provided comprising a housing, and a plumbing fixture. The plumbing fixture includes a water pipe disposed inside the housing and adapted for connection to the water supply piping and a drain pipe disposed inside the housing and fluidly communicating with the fluid intake connection of the tank, the water and drain pipes having inlets accessible from an exterior of the housing.

Other features and advantages are inherent in the apparatus claimed and disclosed or will become apparent to those skilled in the art from the following detailed description and its accompanying drawings.

DETAILED DESCRIPTION OF THE PREFERRED EMBODIMENTS

Figure 1:
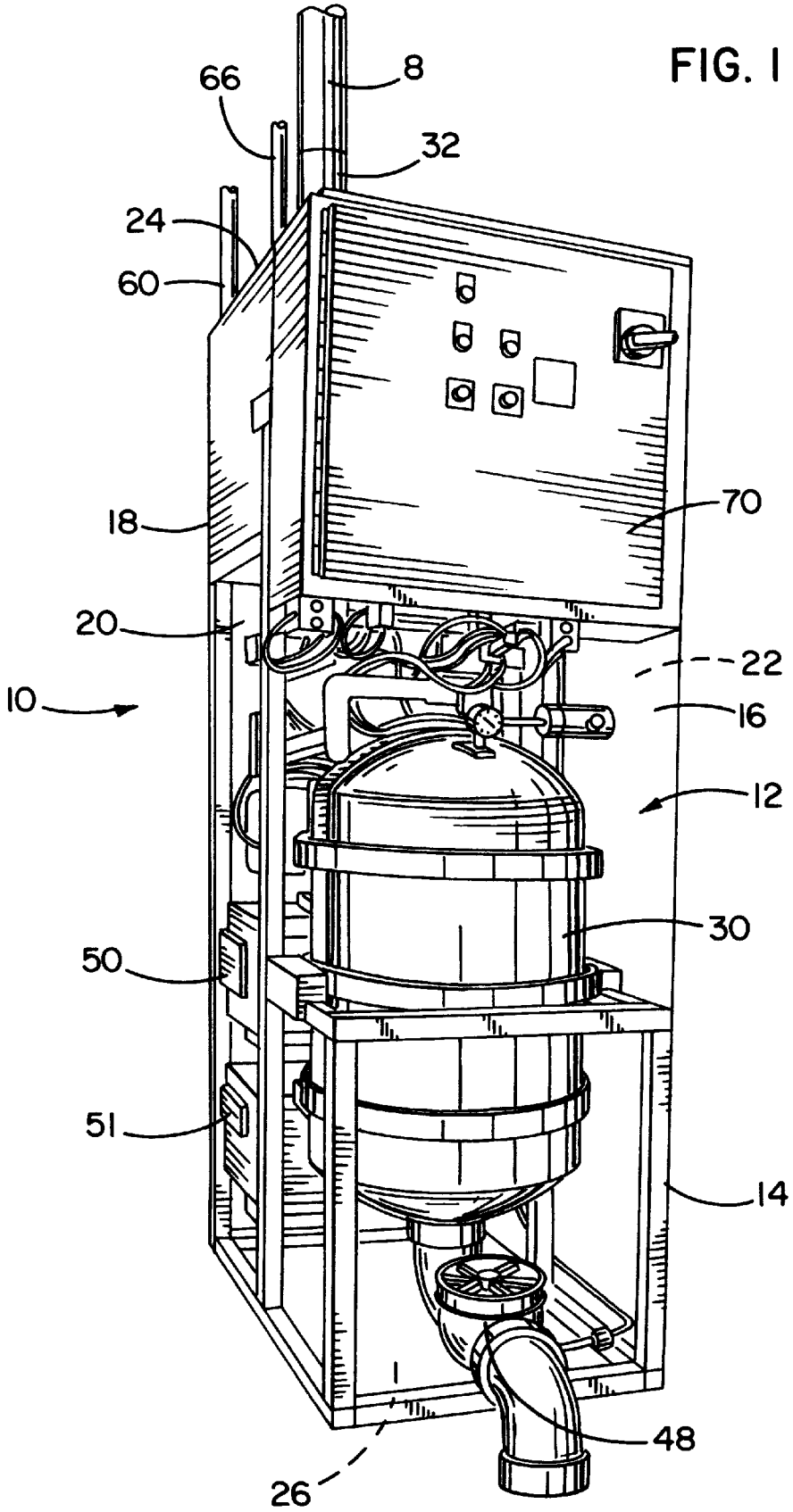
FIG. 1 is a perspective view of a vacuum central unit in accordance with the teachings of the present invention.

Referring to FIG. 1, a vacuum central in accordance with certain aspects of the present invention is indicated generally with reference numeral 10. The vacuum central 10 collects waste fluid from a source such as an existing sink 4, illustrated in FIG. 3. Water is supplied to the sink 4 from existing water piping 6 in the building. Waste fluid collects in the drain of the sink 4 and is transported through vacuum drainage piping 8 to the vacuum central 10. The vacuum drainage piping 8 includes the necessary control valves and actuators to selectively establish communication between the vacuum generated in the vacuum central 10 and the vacuum drainage piping 8 thereby to transport discreet volumes of waste fluid, as is generally know in the art. As described more fully below, the vacuum central 10 has a compact design which allows it to be quickly and easily installed and removed. The vacuum central 10 is particularly suited for office renovations in which one or more plumbing or waste fluid generating fixtures are installed, as will be described in greater detail below.

The vacuum central 10 includes an enclosure 12 comprising a frame 14 for supporting the components of the vacuum central 10. According to the embodiment illustrated in FIG. 1, the enclosure 12 includes a front panel 16, a rear panel 18, a left panel 20, a right panel 22, a top panel 24, and a bottom panel 26 attached to the frame 14 and enclosing the vacuum central 10 to define a periphery of the enclosure 12.

Figure 2:
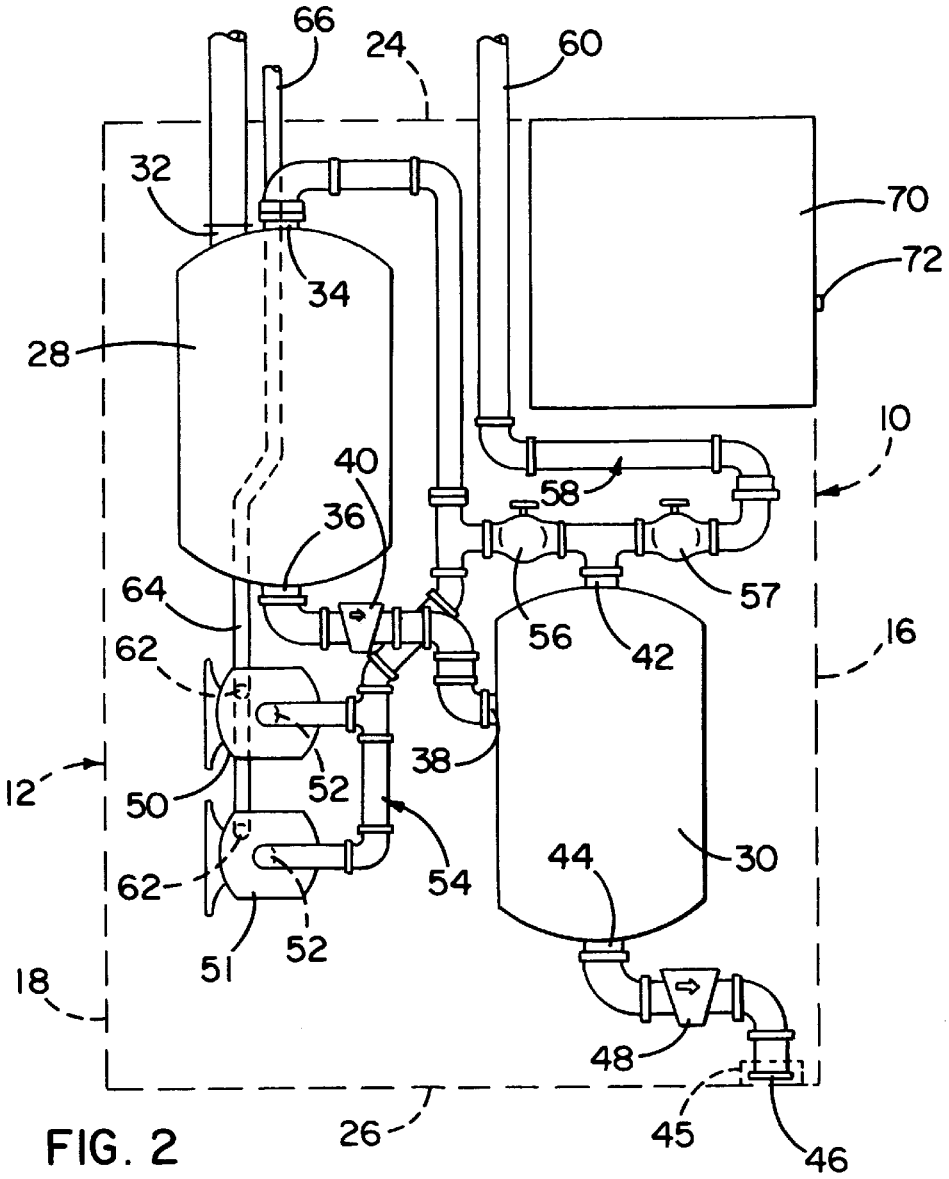
FIG. 2 is a side elevation view, in partial schematic, of the vacuum central unit illustrated in FIG. 1.

Mounted on the frame 14 and inside the enclosure are first and second tanks 28, 30 for collecting and selectively discharging waste fluid. As illustrated in FIG. 2, the first tank 28 is mounted above and to the rear of the second tank 30. The first tank 28 has a waste fluid intake 32 adapted for fluid communication with the vacuum drainage piping 8, a vacuum intake 34, and a drain 36. The second tank 30 has a fluid intake 38 connected to the drain 36 of the first tank 28 by a connecting pipe. An isolation valve 40 is disposed between the fluid intake 38 and the drain 36 to control fluid flow therethrough. The second tank also has a vacuum intake 42 and a drain 44. The drain 44 has a drain outlet 46 for directing fluid as it discharges from the second tank 30. A drain valve 48 is disposed between the drain 44 and drain outlet 46. The isolation and drain valves 40, 48 are preferably check valves. In addition, the drain outlet 46 is connected to a conventional gravity drain leading to a sewer pipe, as described in greater detail below.

First and second vacuum generators, such as pumps 50, 51, are mounted on the frame 14 and connected to the first and second tanks 28, 30 to create a vacuum in the tanks. As best shown in FIG. 2, the first and second pumps 50, 51 have inlets 52 connected by pump inlet piping 54. The pump inlet piping 54 extends from the pump inlets 52 to the vacuum intakes 34, 42 of the first and second tanks 28, 30. In the illustrated embodiment, fluid communication between the pump inlets 52 and the second tank 30 is selectively controlled. Accordingly, a tee is attached to the vacuum intake 42 of the second tank 30 and a first vacuum valve 56 is attached to a branch of the tee at one end. The pump inlet piping 54 is attached to an opposite end of the first vacuum valve 56 thereby to establish fluid communication between the pump inlet piping 54 and the vacuum intake 42. A second vacuum valve 57 is attached to the other branch of the tee, and has vent piping 58 attached thereto. The vent piping 58 has a free end which forms a vent inlet 60 providing access to air at atmospheric pressure.

The first and second tanks 28, 30 may be operated in a full collection mode or a discharge mode, depending on the positions of the first and second vacuum valves 56, 57. In the illustrated embodiment, the first tank 28 is continuously in fluid communication with the pump inlets 52. Thus the first tank 28 is under continuous vacuum during normal operation. Vacuum in the second tank 30, however, is controlled by the first and second vacuum valves 56, 57. Accordingly, in full collection mode, the first vacuum valve 56 is open to establish fluid communication between the second tank 30 and the pump inlets 52. The second vacuum valve 57 is closed to shut off access to atmosphere. With the valves in this position, vacuum is present in the second tank 30. Because substantially equal vacuum levels are present in the first and second tanks 28, 30, the isolation valve 40 allows flow therethrough, so that waste fluid in the first tank 28 flows into the second tank 30. The waste fluid does not flow through the drain valve 48, which is held closed due to a pressure differential across the valve. More specifically, atmospheric pressure is present downstream of the drain valve 48 while negative pressure is a present upstream of the valve. The pressure differential serves to close the drain valve 48, thereby preventing discharge of waste fluid from the second tank 30. Thus, in full collection mode, waste fluid will first fill the second tank 30 before collecting in the first tank 28.

To discharge waste fluid from the second tank 30, the first and second vacuum valves 56, 57 are actuated. The first vacuum valve 56 is moved to a closed position to separate the second tank 30 from the pump inlets 52. The second vacuum valve 57 is moved to an open position to allow air at atmospheric pressure to pass through the vent inlet 60 and into the second tank 30. As a result, atmospheric pressure is present both upstream and downstream of the drain valve 48 and, therefore, the valve 48 opens to allow waste fluid to flow through the valve.

The atmospheric pressure present in the second tank 30 also acts to close the isolation valve 40. Vacuum is still present in the first tank 28 and therefore the upstream side of the isolation valve 40. Atmospheric pressure is present at the downstream side of the isolation valve 40 via the second tank 30. The atmospheric pressure, which is greater than the vacuum, pushes the isolation valve 40 to the closed position, thereby preventing passage of waste fluid. The first tank 28, therefore, continues to collect waste fluid as the second tank 30 empties. Once the second tank 30 is empty, the first and second vacuum valves 56, 57 are returned to their original positions to again create vacuum in the second tank 30, the isolation valve 40 re-opens, and the drain valve 48 closes. While the above description assumes the use of check valves for the isolation and drain valves 40, 48, the present invention is not limited thereto and, in fact, may use other valves, such as control valves having actuators, to execute the collection and discharge functions.

The first and second pumps 50, 51 also have outlets 62 connected to exhaust piping 64 for discharging air displaced by the pumps. A free end of the exhaust piping 64 provides an exhaust outlet 66. In addition, a control panel 70 is provided for controlling operation of the first and second pumps 50, 51 to maintain a desired vacuum level in the tanks 28, 30. The control panel 70 further operates the first and second vacuum valves 56, 57 to selectively switch between full collection and discharge modes. The control panel 70 is attached to the frame 14 and has a power connection 72.

In accordance with certain aspects of the present invention, the vacuum central 10 is provided as a ready-to-install module. Accordingly, interface connections of the vacuum central 10 are located adjacent to the periphery of the enclosure 12. As used herein, the phrase "located adjacent to the periphery" is intended to include any positioning of the interface connections which is readily accessible (i.e., may be reached without removing any components) from outside the enclosure 12. In the preferred embodiment, the fluid intake 32, vent inlet 60, and exhaust outlet 66 all extend outside of the enclosure 12, while the drain outlet 46 is located in a recess 45 (FIG. 2) formed in the enclosure. It will be appreciated that the interface connections may be positioned flush with the periphery of the enclosure 12, in recesses formed in the enclosure 12 (such as recess 45), or in any other manner which allows appropriate access room to the vacuum central pipe connections from outside the enclosure 12. In the preferred embodiment, the fluid intake 32, vent inlet 60, and exhaust outlet 66 are located adjacent to the top panel 24 of the enclosure 12, while the drain 44 is located adjacent to the bottom panel 26. An alternative drain outlet location is illustrated in FIG. 1, in which the drain outlet 46 extends through the front panel 16 of the enclosure 12 near a bottom of the vacuum central 10. The power connection 72 of the control panel 70 is also located adjacent to the periphery of the enclosure 12 as best illustrated in FIG. 2 to facilitate connection to a power source.

Figure 3:
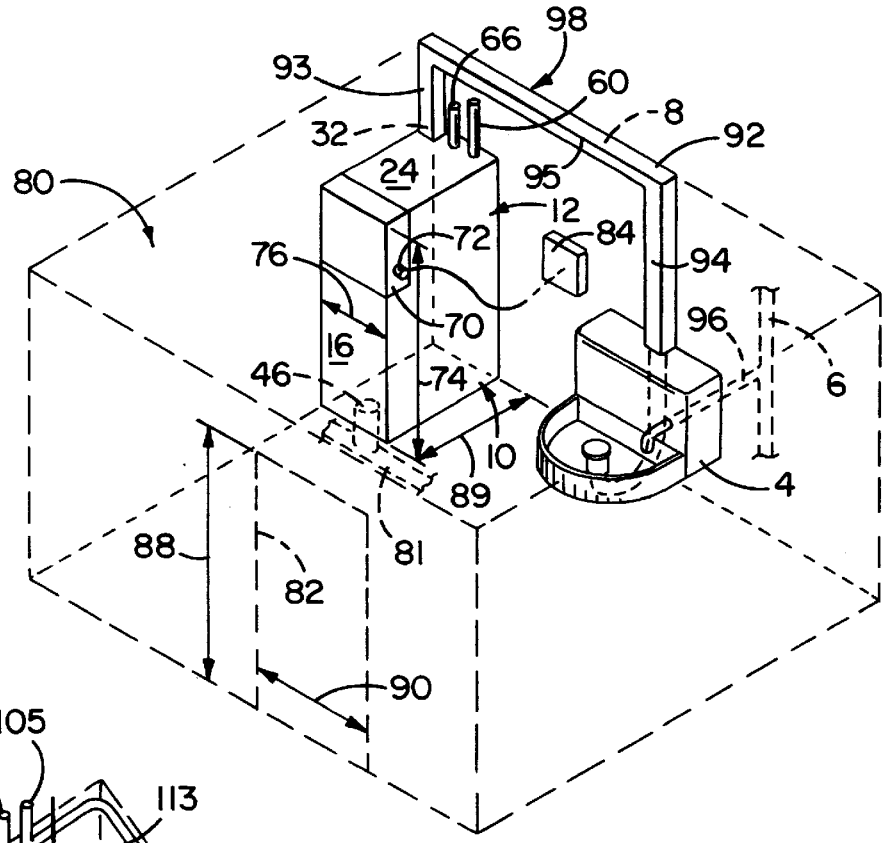
FIG. 3 is a perspective view of a vacuum central unit constructed in accordance with the teachings of the present invention installed in an office and connected to a waste fluid source.

The vacuum central 10 is preferably adapted for installation in an office 80, as illustrated in FIG. 3. The office 80 houses a waste water source, such as the sink 4, which is connected to the building water supply 6. The office 80 is also accessible to a power source 84 and a sewer line 81. In the illustrated embodiment, the fluid intake 32, vent inlet 60, and exhaust outlet 66 of the vacuum central 10 are preferably located adjacent to the top panel 24 of the enclosure 12, while the drain 44 is located adjacent to the bottom panel 26. As a result, the vacuum central 10 may be installed by simply transporting the vacuum central 10 as a unit into the office 80, positioning the vacuum central in the office, connecting the drain outlet 46 of the vacuum central 10 to the sewer line 81, connecting the fluid intake 32 to the vacuum drainage piping 8, and connecting the power connection 72 to the power source 84. During the positioning step, the vacuum central 10 is located so that the drain outlet 46 is accessible to the sewer line 81.

The vacuum central 10 is further preferably sized to fit through the doorway 82 of the office 80. Accordingly, with a doorway having an open height 88 and width 90, the enclosure 12 is sized to have two dimensions which are less than the height 88 and width 90. For example, the enclosure 12 may have a height 74 and width 76 which are less than the open height 88 and width 90 of the doorway 82 so that the vacuum central 10 may be carried in an upright position through the doorway 82. In the alternative, the width 90 and a depth 89 of the enclosure 12 are sized to fit through the doorway 82 when the vacuum central 10 is carried in a horizontal position. In a highly preferred embodiment, the vertical height 74 of the enclosure 12 is significantly greater than the horizontal width 88 and depth 89 in order to accommodate the components of the vacuum central 10 while meeting the doorway pass-through restrictions. For example, in the illustrated embodiment, the height 74 is at least twice that of the width 76.

In the currently preferred embodiment, the vacuum central 10 is adapted to minimize the amount of noise generated during operation. Accordingly, the panels 16-26 which form the enclosure 12 are preferably lined with a sound proof material. In addition, the panels are preferably fire proof to minimize the risk of fires. In accordance with further aspects of the present invention, the panels 16-26 are colored and/or decorated to match the decor of the office 80. The result is not simply a more attractive vacuum central, but a vacuum central which may be quickly and easily installed in an office or other space because it does not require a housing or other structure to hide the vacuum central 10.

Figure 4:
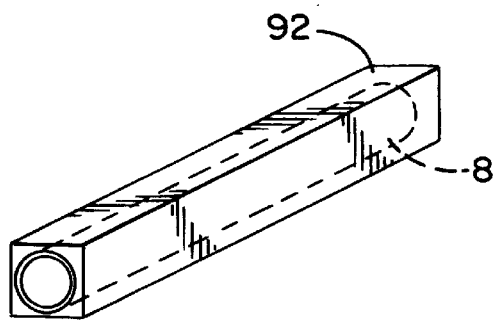
FIG. 4 is a perspective view of a length of vacuum piping enclosed in a piping enclosure.

The vacuum piping 8 is installed inside a piping enclosure 92 to simplify installation of the vacuum drainage system in the office 80, in accordance with additional aspects of the present invention. As best illustrated in FIG. 4, a section of vacuum piping 8 is housed inside and extends through a section of piping enclosure 92. The piping enclosure 92 may be formed, for example, as false columns 93, 94, or a false soffit 95, as illustrated in FIG. 3, to provide an attractive exterior which hides the vacuum piping 8. The vacuum piping 8 is preferably pre-fabricated off-site with the piping enclosure 92 thereby to reduce installation time and complexity. In addition, a water pipe 96 connecting the sink 4 to the existing water supply piping 6 is preferably housed in a similar piping enclosure to further simplify installation.

Figure 5:
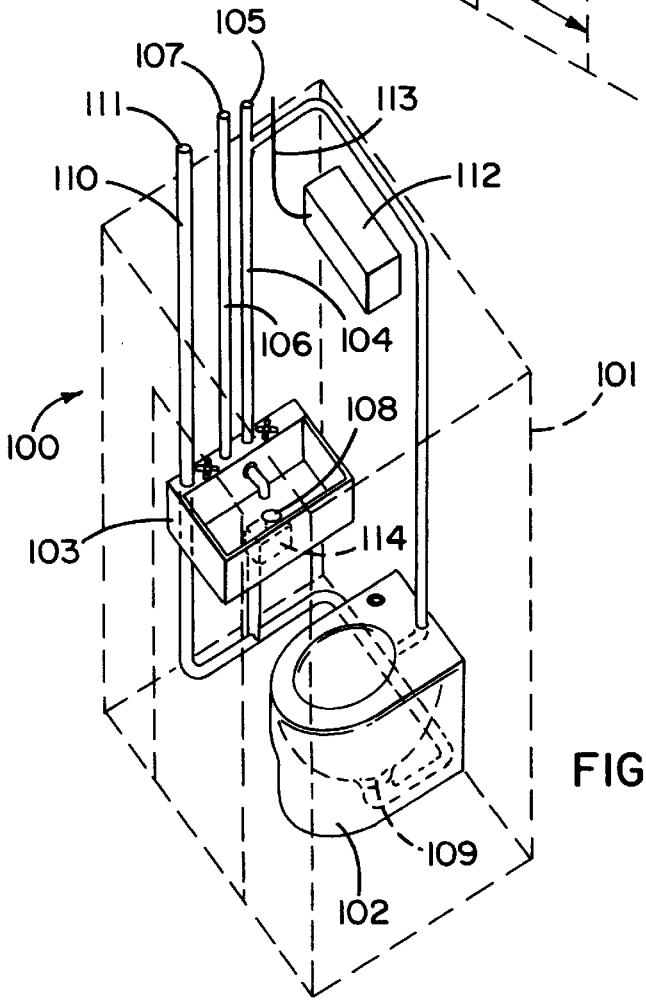
FIG. 5 is a perspective view of a modular toilet room adapted for use with the vacuum central unit illustrated in FIG. 1.

In accordance with further aspects of the present invention, a modular plumbing fixture is provided for use with the vacuum central 10. The modular plumbing fixture may be in the form of a variety of waste fluid generating devices, such as a toilet room 100 illustrated in FIG. 5 or a the modular wet bar/kitchen sink 120 illustrated in FIG. 6. The modular plumbing fixture comprises one or more subassemblies which are pre-fabricated off-site, so that installation is simplified. As shown in FIG. 5, the toilet room 100 comprises a housing 101 in which is disposed a vacuum toilet 102 and a sink 103. It will be appreciated, however, that the toilet room 100 may comprise additional waste fluid sources, such as a shower (not shown). A cold water pipe 104 is connected to the toilet 102 and sink 103 and has an inlet 105 positioned outside the housing 101. A hot water pipe 106 is connected to the sink 103 and has an inlet 107 positioned outside the housing 101. A sink drain 108 is connected to a vacuum interface valve 114 which, in turn is connected to a vacuum pipe 110. The toilet drain 109 is also connected to a vacuum pipe 110. The vacuum pipe 110 has an inlet 111 positioned outside the housing 101. In general, the piping inlets 105, 107, and 111 are located so that they are accessible from outside the housing 101. In the preferred embodiment, the piping inlets 105, 107, and 111 extend beyond a top edge of the housing 101 to facilitate installation in certain applications, such as in an office where the water and vacuum piping are located above a false ceiling. A light 112 is located inside the housing 101 and has an electrical cord 113 for connection to a power supply. The electrical cord 113 also preferably extends outside the housing 101 to facilitate installation. Similar to the enclosure 12 of the vacuum central 10, an outside exterior of the housing 101 is decorated to match the decor of the office.

Figure 6:
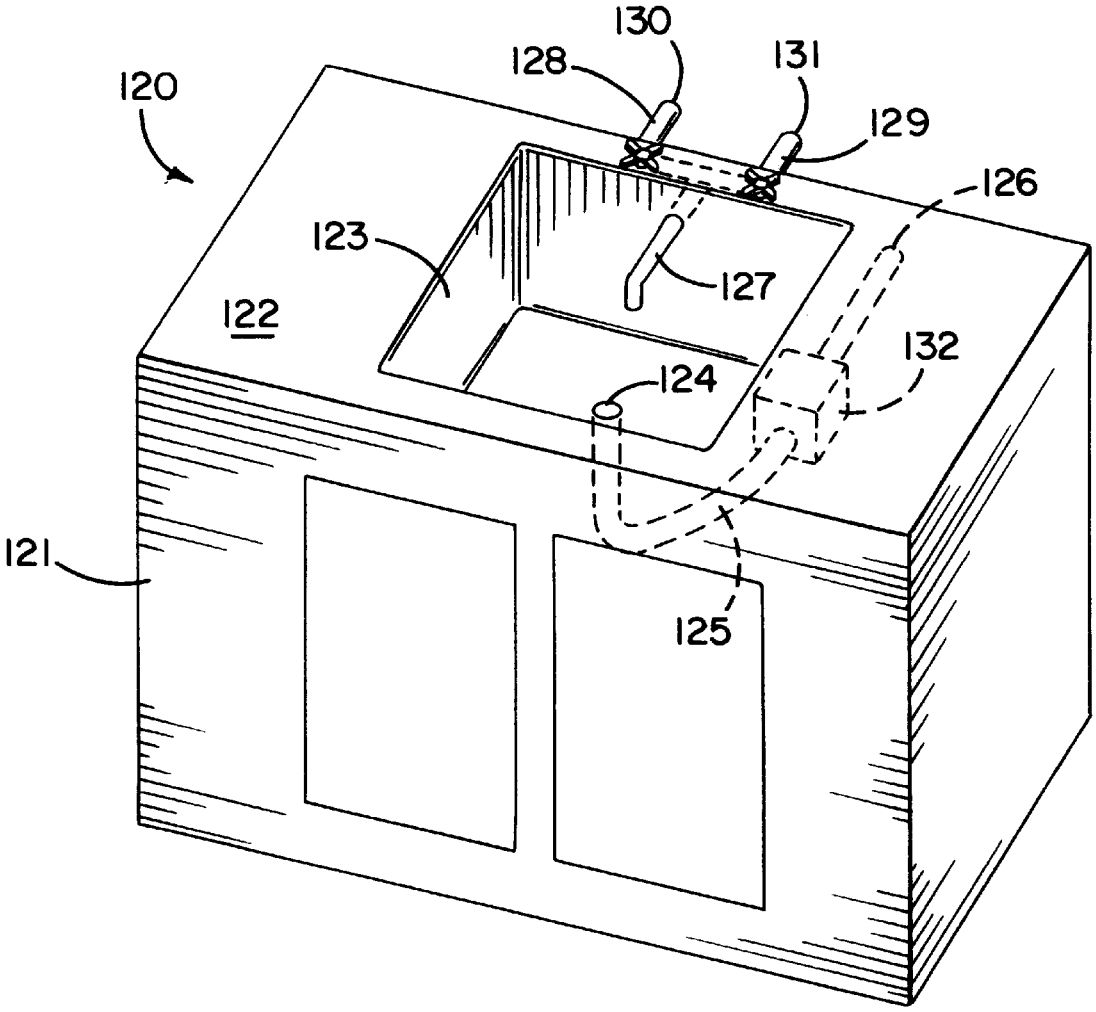
FIG. 6 is a perspective view of a modular wet bar adapted for use with the vacuum central unit illustrated in FIG. 1.

The modular wet bar/kitchen sink 120 shown in FIG. 6 illustrates an alternative modular plumbing fixture. The wet bar 120 comprises a cabinet 121 with a counter 122 in which a sink basin 123 is inserted. The sink basin 123 has a drain 124 connected to a vacuum interface valve 132 which, in turn, is connected to a drain pipe 125. The drain pipe 125 has an inlet 126 adapted for connection to vacuum piping (not shown) in fluid communication with the vacuum central 10 (FIG. 3). A faucet 127 is located above the sink basin 123 and fluidly communicates with hot and cold water pipes 128, 129. The hot and cold water pipes 128, 129 have inlets 130, 131 adapted for connection to existing hot and cold water piping (not shown) in the building. The piping inlets extend outside the cabinet 121 to allow for easy connection to vacuum piping 8 and existing water piping during installation. In the illustrated embodiment, the piping inlets 126, 130, 131 extend past a rear wall of the cabinet 121.

In accordance with still further aspects of the present invention, the modular components described above are used in a modular vacuum drainage system 98 which minimizes installation time and other problems associated with previous drainage systems. As best illustrated in FIG. 3, the modular vacuum drainage system 98 includes the vacuum central 10, the vacuum drainage piping 8 disposed in the piping enclosure 92, and a modular plumbing fixture such as the sink 4. The vacuum central 10 may be quickly and easily installed in place, as described above. The sink 4, which is preferably pre-fabricated off-site, is installed in place as a unit. Piping connections between the sink 4 and vacuum central 10 are made using vacuum piping 8 disposed in the piping enclosure 92. The attractive exterior of the vacuum drainage piping 8 facilitates quick installation by hiding the pipe, thereby eliminating the need to run the vacuum drainage piping 8 above the ceiling or behind walls. In a most preferred embodiment, the water piping 96 connecting the waste fluid source to the water supply is also housed in a piping enclosure. It will be appreciated that the modular vacuum drainage system 98 may incorporate other plumbing fixtures, such as the toilet room 100 or the modular wet bar 120, in place of or in addition to the sink 4 without departing from the scope of the present invention.

In light of the above, it will be appreciated that the present invention brings to the art a modular vacuum drainage system capable of being installed with minimum disruption to plumbing service and personnel. A portable vacuum central is easily installed inside an office without extensive modifications to existing building plumbing systems. Furthermore, the enclosure of the vacuum central reduces noise and provides an attractive exterior, allowing it to be placed in previously unsuitable settings, such as an office. Vacuum and water piping are provided having attractive exteriors to increase piping layout options and facilitate quick installation. In addition, modular plumbing fixtures are quickly and easily installed and connected to the vacuum central to further minimize installation time. As a result, one or more plumbing may be added or a plumbing system may be renovated with minimal disruption to facility operation. The modular vacuum drainage system is particularly suitable for small-scale applications, such as making the facility ADA compliant.

What is claimed is:

1. A modular vacuum central for use with vacuum drainage piping, the vacuum central comprising:

a frame;

a tank mounted on the frame, the tank having a fluid intake connection adapted for fluid communication with the vacuum drainage piping, a vacuum inlet, a vent inlet, and a drain outlet;

a vacuum generator mounted on the frame, the vacuum generator having an inlet in fluid communication with the vacuum inlet to create a vacuum in the tank, and an exhaust outlet;

a control panel attached to the frame and operatively connected to the vacuum generator, the control panel having a power connection; and an enclosure attached to the frame and surrounding the tank and vacuum generator;

wherein the fluid intake connection, vent inlet, drain outlet, exhaust outlet, and power connection are located adjacent to a periphery of the enclosure.

2. The modular vacuum central of claim 1, in which the enclosure comprises a top panel, and the fluid intake connection, vent inlet, and exhaust outlet are disposed above the top panel.

3. The modular vacuum central of claim 1, in which the enclosure comprises a bottom panel, and the drain outlet is adjacent to a periphery of the bottom panel.

4. The modular vacuum central of claim 1, in which the enclosure comprises a plurality of panels attached to the frame to form an enclosed space, and in which the tank and vacuum generator are disposed inside the enclosed space.

5. The modular vacuum central of claim 4, in which the panels comprise a soundproof material.

6. The modular vacuum central of claim 4, in which the panels comprise a decorative exterior.

7. The modular vacuum central of claim 6, in which the modular vacuum central is placed in an office having a decor, and the decorative exterior of the panels matches the decor.

8. The modular vacuum central of claim 4, in which the panels comprise a fireproof material.

9. The modular vacuum central of claim 1, in which the enclosure is sized to fit through a standard doorway.

10. A method of installing a vacuum central in an office of a building having a sewer line, the office having vacuum drainage piping connected to a waste fluid source, and a power source, the vacuum central having a frame, a tank mounted on the frame and having a fluid intake connection, a vacuum inlet, a vent inlet, and a drain outlet, a vacuum generator mounted on the frame and having an inlet in fluid communication with the vacuum inlet to create a vacuum in the tank, and an exhaust outlet, a control panel mounted on the frame and operatively connected to the vacuum generator, the control panel having a power connection, the method comprising the steps of transporting the vacuum central as a unit into the office;

positioning the vacuum central in the office;

connecting the drain outlet of the vacuum central to the sewer line;

connecting the fluid intake connection to the vacuum drainage piping; and connecting the power connection to the power source.

11. The method of claim 10, in which soundproof panels are attached to the frame to form an enclosure containing the vacuum generator and the tank.

12. The method of claim 11, in which the enclosure comprises a bottom panel, and the drain outlet is adjacent to a periphery of the bottom panel.

13. The method of claim 11, in which the vacuum drainage piping is located near a ceiling of the room, and in which the fluid intake connection is located adjacent to a top panel of the enclosure.

14. The method of claim 13, in which the vent inlet and exhaust outlet are located adjacent to the top panel of the enclosure.

15. The method of claim 11, in which the office has a doorway for gaining access to the office, and in which the vacuum central is carried through the doorway during the transporting step.

16. A modular vacuum drainage system for use with existing water supply piping, the modular vacuum drainage system comprising:

a vacuum central including a frame;

a tank mounted on the frame, the tank having a fluid intake connection, a vacuum inlet, a vent inlet, and a drain outlet;

a vacuum generator mounted on the frame, the vacuum generator having an inlet in fluid communication with the vacuum inlet of the tank to create a vacuum in the tank, and an exhaust outlet;

a control panel attached to the frame and operatively connected to the vacuum generator, the control panel having a power connection;

and a plurality of panels attached to the frame to form an enclosure surrounding the vacuum generator and tank;

wherein the fluid intake connection, vent inlet, drain outlet, exhaust outlet, and power connection are located adjacent to a periphery of the enclosure; and a modular plumbing fixture assembly comprising a housing and a plumbing fixture, the plumbing fixture including a water pipe disposed inside the housing and adapted for connection to the water supply piping and a drain pipe disposed inside the housing and fluidly communicating with the fluid intake connection of the tank, the water and drain pipes having inlets accessible from an exterior of the housing.

17. The modular vacuum drainage system of claim 16, in which a vacuum pipe connects the drain pipe of the plumbing fixture to the fluid intake connection of the tank, the vacuum pipe being housed in a piping enclosure.

18. The modular vacuum drainage system of claim 17, in which the vacuum central enclosure, modular plumbing fixture housing, and piping enclosure have decorative exteriors.

19. The modular vacuum drainage system of claim 16, in which the water pipe is disposed inside a water pipe enclosure.

20. The modular vacuum drainage system of claim 16, in which the existing water supply piping includes hot and cold water piping, the water pipe of the modular plumbing fixture comprises a hot water pipe adapted for connection to the existing hot water piping and a cold water pipe adapted for connection to the existing cold water piping, and the modular plumbing fixture comprises a toilet room including a toilet having a water inlet pipe fluidly communicating with the cold water pipe and a drain fluidly communicating with the drain pipe, and a sink having a hot water inlet fluidly communicating with the hot water pipe, a cold water inlet fluidly communicating with the cold water pipe, and a drain fluidly communicating with the drain pipe.

21. The modular vacuum drainage system of claim 16, in which the existing water supply piping includes hot and cold water piping, the water pipe of the modular plumbing fixture comprises a hot water pipe adapted for connection to the existing hot water piping and a cold water pipe adapted for connection to the existing cold water piping, and the modular plumbing fixture comprises a vacuum sink having a sink basin with a drain fluidly communicating with the drain pipe, a hot water inlet fluidly communicating with the hot water pipe, and a cold water inlet fluidly communicating with the cold water pipe.

* * * * *